US005375354A

United States Patent [19]

Rutledge

[11] Patent Number: 5,375,354

[45] Date of Patent: Dec. 27, 1994

[54] AERODYNAMIC OVER-DIMENSIONAL SIGN

[76] Inventor: Edward A. Rutledge, P.O. Box 1634, Wainwright, Alberta, Canada, T0B 4P0

[21] Appl. No.: 949,062

[22] Filed: Sep. 21, 1992

[51] Int. Cl.[5] ..... G09F 21/04; G09F 7/16

[52] U.S. Cl. ..... 40/591; 40/602

[58] Field of Search ..... 40/546, 580, 591, 592, 40/602

[56] References Cited

U.S. PATENT DOCUMENTS

| | | | |
|---|---|---|---|
| Re. 29,462 | 11/1977 | Tchakgarian | 40/602 X |
| 1,761,868 | 6/1930 | Burke | 40/580 |
| 2,689,422 | 9/1954 | Hoff | 40/580 X |
| 3,768,187 | 10/1973 | Dunne | 40/602 |
| 4,240,220 | 12/1980 | Smith | 40/580 X |
| 4,768,300 | 9/1988 | Rutili | 40/546 |
| 4,910,898 | 3/1990 | Hector | 40/602 X |

*Primary Examiner*—Kenneth J. Dorner
*Assistant Examiner*—J. Silbermann
*Attorney, Agent, or Firm*—Bauer & Schaffer

[57] ABSTRACT

An apparatus for reducing air drag against an apparently flat message surface when the message is intended for day or night viewing from approximately directly in front or behind. Symbols comprising the message, or their backgrounds are inclined backwards as louvers to allow free air passage. The symbols or their backgrounds may be placed on a plane behind and parallel to the apparent message surface, and viewed through hole(s) cut in that surface, with a gap between the two planes allowing air flow. Night-lights above each symbol may be provided to ensure accurate night viewing.

7 Claims, 2 Drawing Sheets

AERODYNAMIC OVER-DIMENSIONAL SIGN

Continuing rising cost of vehicular fuels, in particular fossil fuels, is leading to a growing demand for aerodynamically smoother-shaped motorized vehicles of all types, as a way of reducing air-drag and hence reducing fuel costs. Cars and mini-buses are now carefully designed to achieve minimum air-flow resistance, and trucks are built new or retro-fitted to have air-scoops to deflect the air above the load, which is characteristically a square shape and creates a serious drag.

One type of transport vehicles which has received little such attention to date is "special vehicles": long loads, wide loads, highway maintenance, and so forth. Presumably because they represent a smaller fraction of highway traffic than the categories of vehicle mentioned above, and because they are subject to detailed restrictions as to signage which must be placed in conspicuous positions, little has been done to reduce the air-drag of the vehicles. These reasons, however, are small comfort to individual operators who must earn their daily living in the face of rising fuel costs.

The present invention addresses one aspect of this problem: the "warning" and "danger" signs (and similar such) placed atop highway or other transport vehicles are characteristically legally defined as being of oblong and rectangular shades (and appear almost intentionally to have been designed to stop air, rather than deflect or transmit it).

BRIEF DESCRIPTION OF THE PRESENT INVENTION AND PRIOR ART

The inventor has owned pilot (escort) vehicles for highway loads for a number of years, and noticed the fuel consumption of these vehicles to be quite high. Accordingly, he designed an ingenious aerodynamic sign which conforms to the local highways department specifications as far as legibility, and yet allows air to pass right through it; thereby substantially reducing air drag. The essence of the invention, which is very simple, is to have the various letters or symbols being displayed to be themselves either individual louvers, slanting at a substantial angle, or to be set back on a surface behind the front symbol surface and viewed through an open cut-out of the same shape as the symbol. This allows free air passage.

Because these highway vehicle warning signs are intended and specified only to be read front-on, or at most at an angle of a few degrees, and from a large distance away, this solution conforms perfectly both to the actual need for highway legibility and to the specifications of the highway department where the inventor resides, and presumably those of other places. These highway department specifications (in the example given, Alberta, Canada) show only one view: front view from directly in front of the sign. Thus when the inventor's sign is on top of a highway vehicle, an approaching vehicle on the same road (either in front or behind) will see the symbol surface as solid, and will read the symbols without trouble. In night applications, the reading of each symbol is guaranteed by the inventor's placing at least one small light above the louver or cut-out of each symbol, so the sign will be brightly displayed. Only viewed from a wide angle to the side from very close at hand might the louvers and cut-outs become visible and interfere in any way with reading the sign, and in all anticipated cases of "wide load" or dangerous load" the sign itself will have become superfluous long before this point, since the sign will already have been read from a distance, and from such close Quarters the load itself will have become obvious.

Nothing in the prior art appears to closely resemble this special application. Canadian patent No. 1,011,945 specifies "wind tunnels" in a stationary highway sign, but this sign has letters and symbols which are themselves a solid surface and are affixed in a flat plane in front of the wind tunnels. Canadian patent No. 997,145, like the former, is for stationary sign applications of large surface area; in this case illuminated from within. While these symbols utilize a very small amount, of louver to transmit strong air currents, they are limited in this both by the fact that the illumination (which is behind the symbols) can not be allowed to "leak" between the cracks (which must therefore be small) and by the important and absolute need for perfect legibility even close-up at wide angles. This need has been stated eloquently in the preamble to Canadian patent No. 1,011,945 mentioned above, and bears repeating: "It is essential that the wording be displayed in such a manner that drivers possessed of only ordinary vision and driving skills are able to read and comprehend the message at a glance while travelling at highway speeds and concentrating primarily on avoiding collisions with other vehicles." The point to be made here is that in stationary signs, a driver may, due to complexities of entrance/exit ramps or heavy traffic, or both, have only a split second to read and decode a message of several words, frequently unfamiliar ones, frequently for the first time. Thus the louver can only be very slight, since the driver may very well read the sign only at the last minute from a wide angle as the sign is passed. Hence in this application the louver will be of little use, since the amount of air passed will be only a small fraction of the total surface area. But in a perpendicular view with few words, where long-distance recognition is the basic need, the louver and set-back symbol is an excellent solution to the air-flow problem.

One object of the invention is to provide an apparatus for the display of visual symbols designed so that the symbols themselves appear from distant viewing to be configured on a flat surface perpendicular to the line of viewing but are in fact either slanting at an angle oblique to the line of viewing, such that air may freely pass around them, or viewed through a hole in said surface, through which hole air may freely pass.

A further object of the invention is to provide a means of conveying an apparently flat symbolic message whose dimensions are specified by a legal body having authority over highway transport signage, to be affixed to highway vehicles for warning other drivers of dangerous or unusual loads or conditions, while at the same time substantially reducing the air-drag effect of said means on said highway vehicles, said means comprising:

(a) a frame, said frame to have inner dimensions sufficient to closely surround the outer dimensions of said specified apparently flat symbolic message;

(b) a means of affixing said frame to the vehicle;

(c) a group of pieces placed inside the frame, said pieces being designed so that they will allow accurate reading of said symbolic message from a position either approximately in front or approximately behind the vehicle, or both, and at the same time allow passage of air through the frame; in which the symbols are either louvers designed to slant at an oblique angle from the apparent symbol-bearing surface, or pieces viewed through holes in the apparent symbol-bearing surface, said holes being cut to approximate the shape of the symbols viewed therethrough, and said symbols viewed therethrough being affixed in such a manner as to provide a gad for air flow: and (d) a means for lighting the symbols for accurate night viewing.

A further object is to provide an apparently flat symbolic sign to be mounted on a vehicle comprising:

(a) mounting means for said sign;

(b) a plurality of planar components adapted to carry a visual symbol; and (c) said components being in the form of louvers.

A still further object is to provide an apparently flat symbolic sign to be mounted on a vehicle comprising:

(a) mounting means for said sign;

(b) a plurality of planar components adapted to carry a visual symbol; and (c) said components having openings through which a visual symbol may be seen.

DETAILED DESCRIPTION OF THE PREFERRED EMBODIMENT

For this description of one example the invention, reference will be made to the drawings in which.

Figure 1:
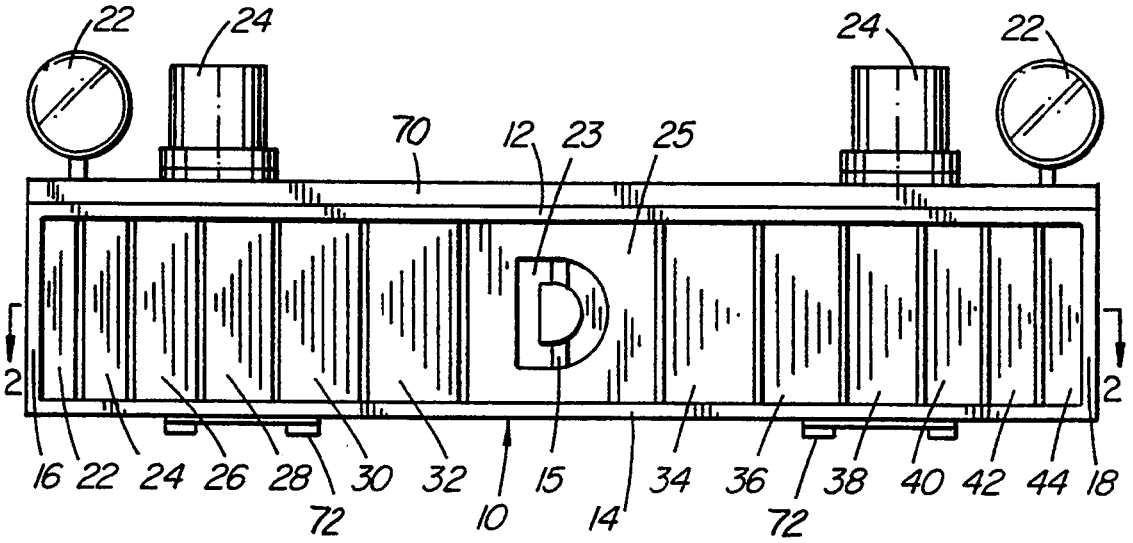
FIG. 1 is a front elevation of a sign manufactured according to the invention and conforming to the specifications for sign for "over-dimensional loads" as described in the "Alberta Transportation and Utilities Escort Drivers" handbook.

With reference to FIG. 1, the outer dimensions of the oblong shape of the symbol-bearing surface are first designed to confirm with the specifications of the appropriate highway regulations.

As seen in FIG. 1, a rectangular frame indicated generally at 10 is comprised of top and bottom plates 12 and 14 and end plates 16 and 18. A plurality of louvers 22, 24 26, 28, 30 and 32 on the left hand side of the sign as seen in FIG. 1, and a similar plurality of louvers 34, 36, 38, 40, 42 and 44 on the right hand side of the sign as seen in FIG. 1, admit air through gaps 50, 52, 54, 56 and 58 shown on the left side of FIG. 2 and through gaps 60, 62, 64, 66, and 68 shown on the right side of FIG. 2.

The sign portrayed is specified by the highway regulations to be of alternating red and white stripes of given dimensions, with a "D" in the middle between these stripes. Accordingly the louvers are manufactured and placed so that when looked at from the front, as in FIG. 1, they will appear to be of these dimensions, when in fact they are wider and slanting backwards to give the gaps for air flow.

For the dropped-back symbols, such as the "D" 23 in FIG. 1, either the symbol or its background 25 is chosen to be flush or near-flush with the front plane, and the other is then to be spaced behind it. Here the "D" shape is cut from the specified red colour background 25, in FIG. 1; this is discarded, and a piece is fabricated either to the same size or slightly larger in area, from a white material. Then the white "D" 17 is placed slightly behind, lined up exactly with the "D" cut-out, and affixed by some appropriate means that does not appear visibly when viewed from directly in front; here white-coloured pieces 15 are attached to the back of the square red piece and the front of the white "D" 17 so that from a distance pieces 15 are invisible. Now air may pass freely through the hole cut out of piece 25, as indicated by arrows 67 and 69 in FIG. 2.

Figure 3:
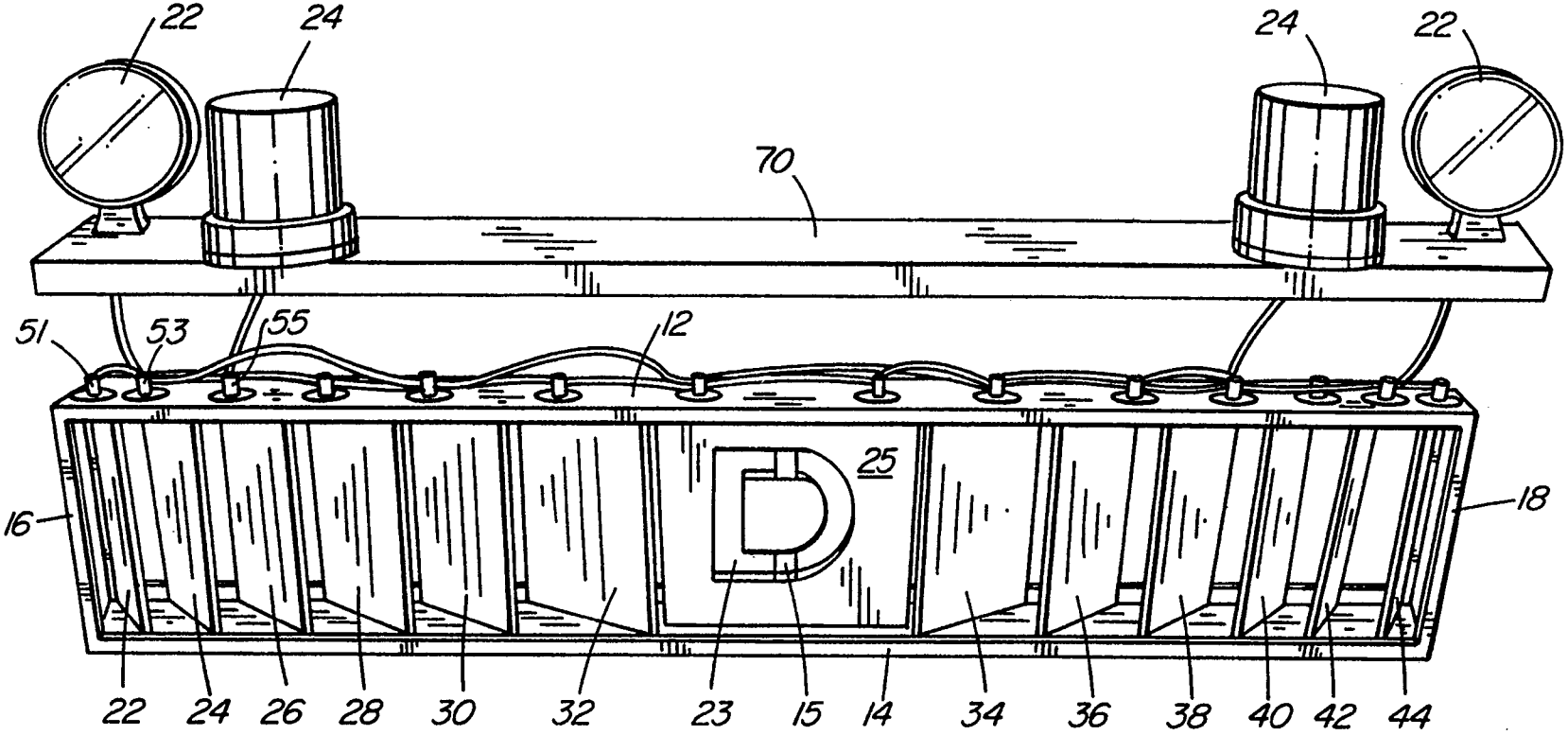
FIG. 3 is a front elevation view of said sign manufactured according to the inventive process and conforming to the specifications for sign for "over-dimensional load" as described in the "Alberta Transportation and Utilities Escort Driver's" handbook, seen from closer up than FIG. 1, and with top lights exploded upwards to display the illuminating bulbs.

Now holes are drilled above and in front of each of the slanted louver pieces, through the top of the frame 12 in FIG. 3, and a series of small lights are inserted, one into each hole to illuminate the louvered symbols. In FIG. 3 these are numbered 51, 53, 55 and so forth. Only the socket ends of the bulbs are shown; the bulbs are hidden by the frame 12. When the weather-sealing top box 70 is in place, the sockets of the bulbs are hidden from view and protected from the elements. The lights 22 and 24 affixed on top of this box frame 70 are as specified in highway regulations.

Figure 2:
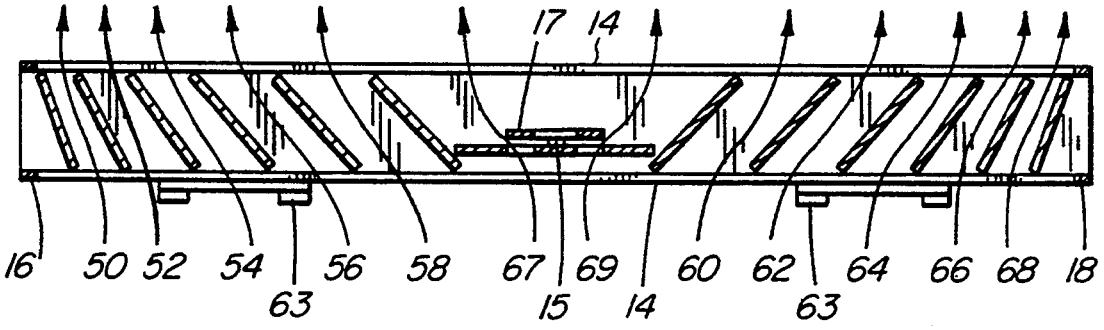
FIG. 2 is a section view taken along 2—2 of FIG. 1.

Finally the signage in this example is affixed to a vehicle using the bottom brackets 72 seen in FIGS. 1 and 2.

It can be seen from the foregoing description that this use of slanting louvered or set-back symbols, or a mixture of the two as in this particular description, will serve a useful purpose in applications where close wide-angle viewing of the signage is not very important, yet wind flow against the sign area is a problem. Any combination of letters or symbols can be arranged according to the invention, and will transmit substantial amounts of air. Thus even stationary signs in placements where distant straight-on viewing is most important will benefit from this invention.

It can also be seen that viewing of the same symbolic message from the rear can be effected without great difficulty; in this example simply by adding a second row of illumination lights above the back side of each louver piece, and a second "D" cut-out symbol constructed similar to the one at the front, pieces 23, 25, and 15 in FIG. 1, but facing backwards, and also lit with extra top lights.

Messages with other dimensions or wording, such as "wide load" or "warning" can be accommodated using the methods described herein; customarily these are specified to be read in one direction only, but where necessary can be set up to be read both front and back as described.

The foregoing is by way of example only and the invention should be limited only by the scope of the appended claims.

The embodiments of the invention in which an exclusive property or privilege is claimed are defined as follows:

1. A sign mounted on a vehicle transverse to the direction of movement of said vehicle comprising: a generally oblong open frame having top, bottom and a pair of end walls, said frame being adapted to be mounted on the vehicle with its long axis perpendicular to the direction of travel; a plurality of louvers at least some of which contain a visual symbol, mounted between the top and bottom walls, said louvers being divided into two sets relative to the opposite sides of the center line of the frame, the louvers of one set being affixed in spaced relationship parallel to each other at a first angle to the direction of travel and the louvers of the other set being affixed in spaced relationship parallel to each other at a second angle opposite to said first angle, said angles being such that the louvers permit air to flow between them while the symbols appear to be configured as on a flat surface perpendicular to the line of viewing.

2. The sign according to claim 1, including at least a planar member containing a visual symbol arranged in said frame between the louver sets in a vertical plane, perpendicular to the direction of travel.

3. The sign according to claim 2, wherein said visual symbol is formed as a cut out on at least one of said louvers or planar members.

4. The sign according to claim 3, including a panel mounted behind said cut out and spaced from said louver or planar member.

5. The sign according to claim 2, wherein said frame is provided similarly at the back as at the front with louvers so as to be read from either the front or back.

6. The sign according to claim 2, including means for illuminating the symbols.

7. The sign according to claim 6, wherein said means for illuminating said symbols comprise a plurality of bulbs mounted in the top wall adjacent and above said louvers and planar members, respectively.

* * * * *